United States Patent [19]

Mayrhofer

[11] Patent Number: 5,025,852

[45] Date of Patent: Jun. 25, 1991

[54] CONTINUOUS CASTING MOLD ARRANGEMENT FOR CASTING BILLETS AND BLOOMS

[75] Inventor: Karl Mayrhofer, Naarn, Austria

[73] Assignee: Voest-Alpine Industrieanlagenbau, Austria

[21] Appl. No.: 538,137

[22] Filed: Jun. 25, 1990

Related U.S. Application Data

[62] Division of Ser. No. 361,123, Jun. 5, 1989, abandoned.

[30] Foreign Application Priority Data

Jun. 8, 1988 [DE] Fed. Rep. of Germany ..... 3819492

[51] Int. Cl.[5] ..... B22D 11/00; B22D 27/02

[52] U.S. Cl. ..... 164/468; 164/504

[58] Field of Search ..... 164/468, 504

[56] References Cited

U.S. PATENT DOCUMENTS

| | | | |
|---|---|---|---|
| 4,103,730 | 8/1978 | Dussart | 164/468 |
| 4,150,712 | 4/1979 | Dussart | 164/504 |
| 4,178,979 | 12/1979 | Birat | 164/504 |
| 4,200,137 | 4/1980 | Zavaras | 164/504 |
| 4,933,005 | 6/1990 | Mulcahy | 164/468 |

FOREIGN PATENT DOCUMENTS

| | | | |
|---|---|---|---|
| 55-40004 | 3/1980 | Japan | 164/504 |
| 57-94458 | 6/1982 | Japan | 164/504 |

*Primary Examiner*—Richard K. Seidel
*Assistant Examiner*—Rex E. Pelto
*Attorney, Agent, or Firm*—Handal & Morofsky

[57] ABSTRACT

There is disclosed a continuous casting mold for casting billets and blooms including a stirring means to produce a rotating electromagnetic field of force. It is sought to be able to use a continuous casting mold of this type facultatively with free-stream casting or with immerged-tube casting. To this end, the continuous casting mold includes at least two stirring means arranged one above the other in height. At least one the stirring means is arranged in the upper half of the continuous casting mold and at least one of the stirring means is arranged in the lower half of the continuous casting mold. The at least two stirring means are electrically connected and operable independently of one another.

10 Claims, 2 Drawing Sheets

CONTINUOUS CASTING MOLD ARRANGEMENT FOR CASTING BILLETS AND BLOOMS

Figure 1:
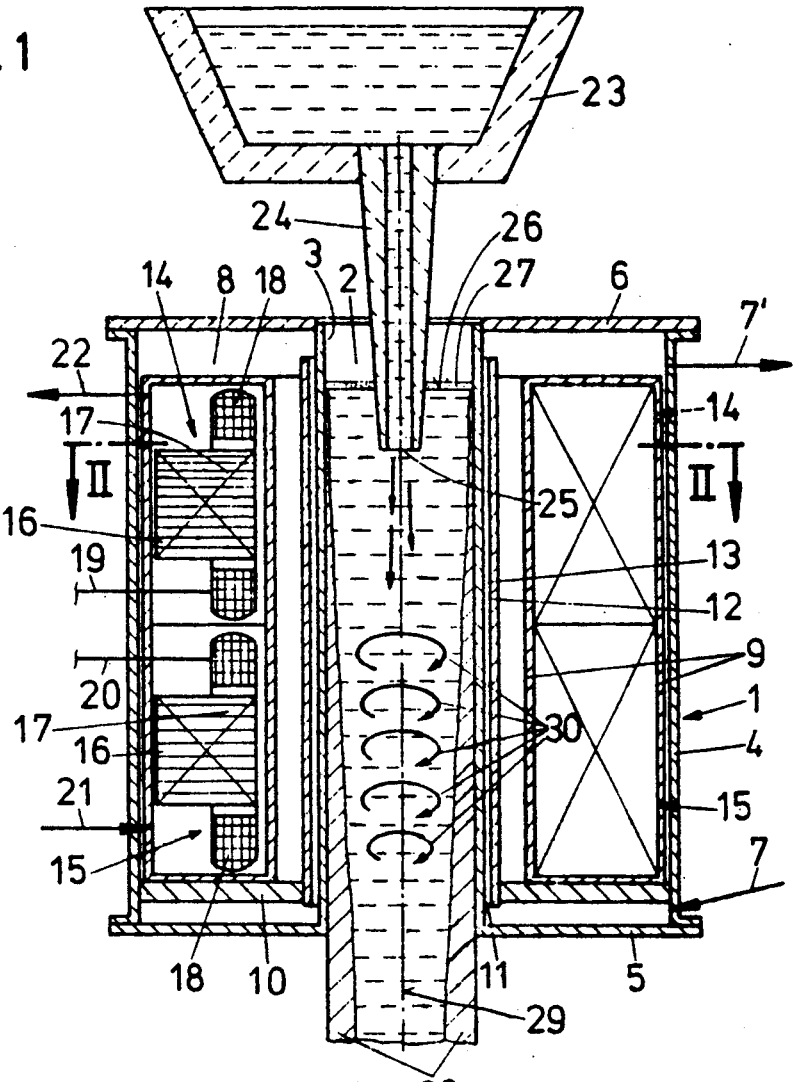

This application is a continuation of application Ser. No. 361,123, filed June 5, 1989 abandoned.

The invention relates to a continuous casting mold for billets and blooms, in particular a continuous casting mold for steel casting, comprising a stirring means to produce a rotating electromagnetic field of force.

It is known (AT-B-359,225, U.S. Pat. No. 4,026,346, U.S. Pat. No. 2,944,309) to influence the solidification of continuously cast high-melting metals, such as steel, by applying rotating electromagnetic fields of force, thus attaining metallurgical and technological advantages, in particular a more uniform and fine texture of the cast strand, a uniform distribution of non-metallic inclusions, an improved heat elimination, etc. According to the prior art, the application of the rotary field is effected in the region of the mold or slightly below the same.

Depending on the melt quality, the casting of strands having billet or bloom cross sections takes place either according to the free-stream casting technique, in which a casting stream emerging freely from a tundish positioned above the continuous casting mold flows into the continuous casting mold and penetrates into the melt present within the mold cavity, or according to the immerged-tube casting technique, in which a casting tube arranged at the tundish is immerged in the melt present within the mold cavity such that the casting stream gets into the melt in the mold cavity by avoiding air contact. The casting level is covered by casting powder.

In the latter case, the melt is protected from reoxidation by the immerged tube and by the casting powder, wherein, however, care has to be taken when providing electromagnetic agitation that not too vigorous a movement of the melt occurs on the casting level, because in that case casting powder, which serves to lubricate the strand shell during sliding at the mold, will get into the interior of the strand, being included there.

In contrast, with free-stream casting, with which oil applied at the mold walls is used for lubrication, it is sought to provoke a melt rotation as strong as possible (2 to 3 Hertz) on the casting level in order to let the gases carried away with the casting stream that penetrates the melt in the continuous casting mold more easily ascent towards the casting level, thereby inducing what is called a washout effect.

Known continuous casting molds comprising stirring means differ in terms of construction according to immerged-tube or free-stream casting, the configuration of the stirring means, in particular, being selected according to the casting process applied.

In steelworks, there is often the problem that a wide range of different steel grades is to be cast continuously, the immerged-tube casting process being preferred for some steel grades—primarily steel grades killed by aluminum—and the free-stream casting process being preferred for other steel grades—such as steels killed by silicon—, for metallurgical reasons. Since the exchange of continuous casting molds requires too much time when changing from the free-stream casting process to the immerged-tube casting process and vice versa, in particular when casting small quantities, some compromise with respect to structural configuration that is suited more or less to both casting processes has had to be made in order to be able to carry out both processes with one and the same continuous casting mold, yet no optimum results have been obtained for either casting process.

The invention aims at avoiding these difficulties and has as its object to provide a continuous casting mold of the initially defined kind, which may be used both for the immerged-tube casting process and for the free-stream casting process such that an optimum texture of the cast strand and as few inclusions as possible will be guaranteed with both casting processes.

In accordance with the invention this object is achieved in that the continuous casting mold comprises at lead two stirring means arranged one above the other in height, at least one of which is arranged in the upper half of the continuous casting mold and at least one of which is arranged in the lower half of the continuous casting mold, the at least two stirring means being electrically connected and operable independently of one another.

The continuous casting mold according to the invention allows both free-stream casting and immerged-tube casting to be realized without having to carry out any conversion work, an optimum stirring effect being attainable in both cases by setting into operation either of the two stirring means. Thus, with free-stream casting, at least the upper of the two stirring means is set into operation, whereby gases penetrated into the melt are effectively washed out, whereas, with immerged-tube casting, the lower stirring means is set into operation in order to avoid movement of the bath on the casting level. Due to the fact that an optimumly positioned stirring means is always available to either of the two casting processes, it is possible to do with a lower stirring performance with both casting processes, i.e., to consume less energy, than with continuous casting molds that do not have such dispositions.

Advantageously, one stirring means is arranged near the upper end, i.e., on the run-in side, of the mold cavity and one stirring means is arranged near the lower end, i.e. on the run-out side, of the mold cavity.

In order to avoid too much screening of the electromagnetic field of force by the continuous casting mold, the stirring means suitably are arranged within a mold internal space extending over approximately the entire length of the continuous casting mold and passed by a coolant. Advantageously, the stirring means are arranged in a closed casing inserted in the tubular mold internal space passed by a coolant, a stirring means coolant flowing through the closed casing. The arrangement of the stirring means in a separate closed casing within the mold cavity has the advantage that the coolant recirculating system for the stirring means may be adapted to the amount of coolant required by the same irrespective of the internal cooling of the continuous casting mold.

According to a preferred embodiment, two stirring means arranged immediately above each other are provided, each stirring means extending approximately over half the height of the mold cavity in terms of height. In this manner, stirring is feasible over a larger height region of the mold cavity both with immerged-tube casting and with free-stream casting.

Figure 2:
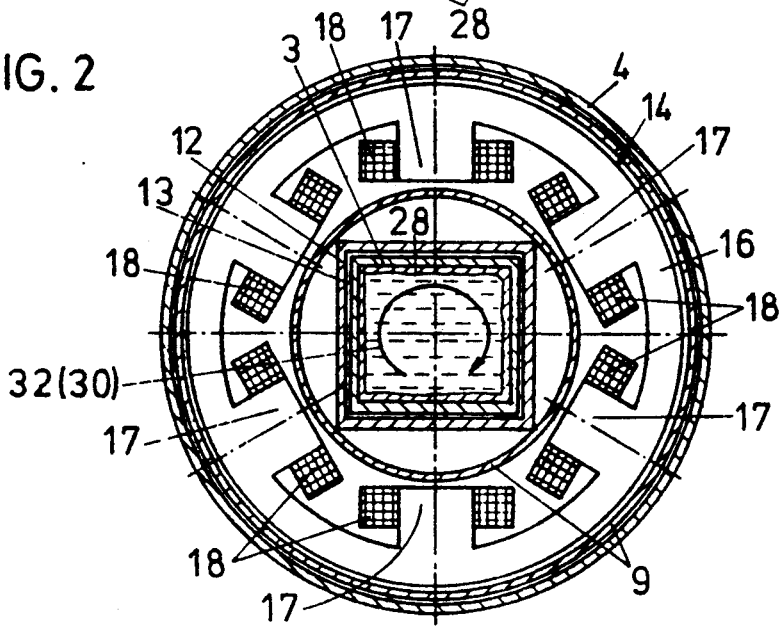
Figure 3:
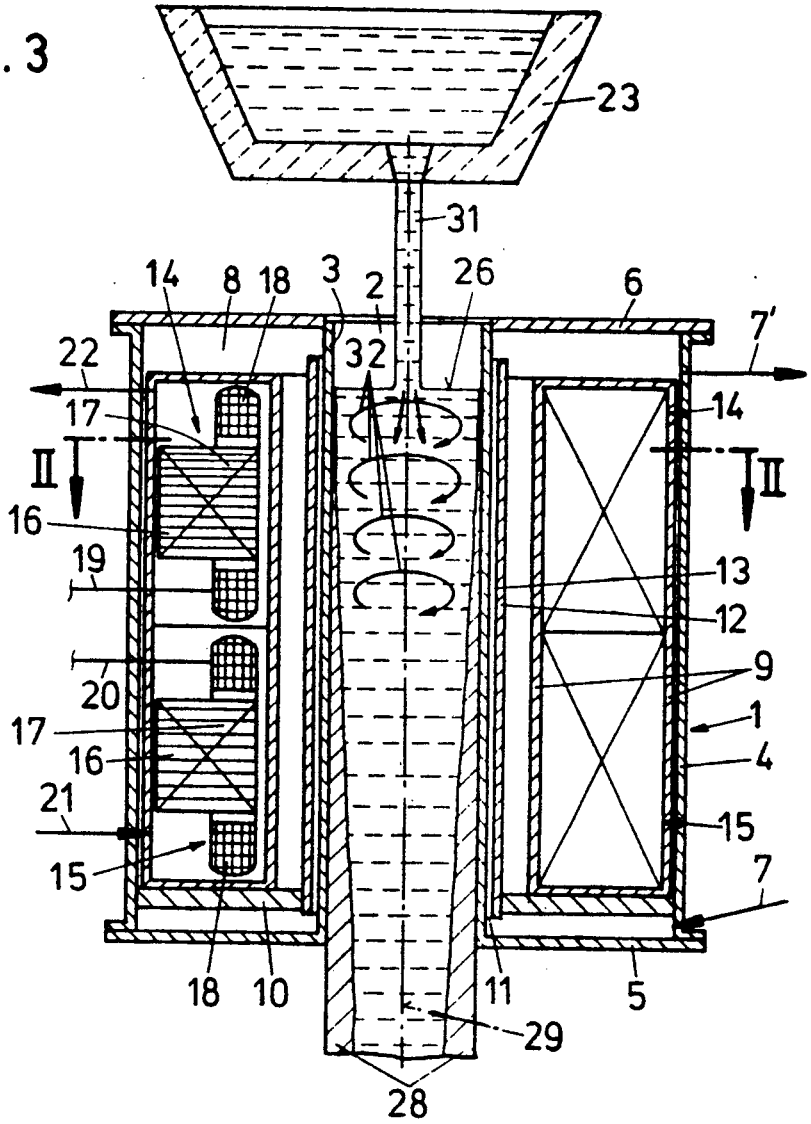

The invention will now be explained in more detail with reference to the accompanying drawings, wherein:

FIGS. 1 and 3 represent one and the same continuous casting mold in the longitudinal section, once (FIG. 1)

with immerged-tube casting, once (FIG. 3) with free-stream casting;

FIG. 2 is a section perpendicular to the longitudinal axis of the continuous casting mold according to FIGS. 1 and 3, each along the line of section II—II of these Figures.

A continuous casting mold 1 for casting billets, which is designed as a tube mold comprises an approximately square straight and vertically extending mold cavity 2 delimited by a tube 3 of copper or a copper alloy. About this copper tube, an outer jacket 4 is provided, which is tightly connected to the tube 3 via annular base and cover plates 5, 6. On the lower end of the continuous casting mold a mold cooling-water inlet 7, on the upper end a mold cooling-water outlet 7', are provided.

Within the mold internal space 8 formed by the outer jacket 4 and the tube 3, and through which a coolant flows, a closed circular-ring-cylindrical casing 9 of stainless steel is installed, resting on a flange 10 arranged above the base plate 5. This flange 10 is fastened to the outer jacket 4, reaching towards the tube 3 on leaving free a gap 11. On this flange 10, a water conducting jacket 12 is provided, leaving free a flow gap 13 for the mold coolant relative to the tube 3.

Within the closed casing 9, two stirring means 14, 15 are installed so as to be disposed one above the other in height, each serving to generate a rotating electromagnetic field of force. Each stirring means 14, 15 has an iron core 16 of dynamo sheet, on which inwardly extending projections 17 are provided to receive coils 18 of copper wires. Each of the stirring means 14, 15 extends over approximately half the height of the mold cavity 2, or of the mold internal space 8, in terms of height and each of the stirring means is individually provided with an electric connection 19, 20 in a manner that each of the stirring means is operable independently of the other stirring means.

On the lower end of the closed casing 9, an inlet nozzle 21 for cooling medium, for instance, oil or water, and on the upper end an outlet nozzle 22 for this cooling medium are provided.

According to FIG. 1, an immerged tube 24 fastened to a tundish 23 reaches centrically into the mold cavity 2 and, on its free end, has an outflow opening 25 directed downwards. The casting level 26 lies above this outflow opening 25 and is covered by a casting powder 27. The strand shell forming at the tube 3 is illustrated schematically and denoted by 28.

With the immerged-tube casting process only the lower stirring means 15, i.e., that arranged farther remote from the casting level 26, is switched on. It generates a rotational movement about the longitudinal axis 29 of the mold cavity 2 in the melt, as is illustrated by arrows 30.

According to FIG. 3, a casting stream 31 freely running out of the tundish 23 enters the mold cavity 2. In this case, the upper stirring means 14, i.e., that disposed next to the casting level 26, is switched on. A stirring movement is created in the melt that constitutes the casting level and in the melt provided immediately therebelow, as is indicated by arrows 32. With free-stream casting, even the lower stirring means 15 may additionally be set into operation.

The invention is not limited to the embodiment represented in the drawings, buy may be modified in various aspects. There may, for instance, be provided more than two stirring means distributed over the height of the mold, wherein, however, at least one must be provided in the region of the casting level 26 and one must be provided in the region of the lower half of the mold cavity 2. Stirring means optionally arranged therebetween may be operated according to the requirements implied by the various casting processes. The mold cavity 2 also may be curved in the longitudinal direction (in case of a so-called arcuate mold) or may be arranged in a manner deviating from the vertical line.

What I claim is:

1. A method of continuously casting metal billets and blooms utilizing a free-stream casting technique and a stacked, plurality of electromagnetic stirring means arranged over the height of a continuous casting mold, said continuous casting mold being top fed, wherein:
   a) a casting stream of molten metal freely runs out of a tundish into said continuous casting mold in sufficient volume to form a casting level of said molten metal near the top of said continuous casting mold;
   b) activating only the electromagnetic stirring means arranged over a top half of said continuous casting mold to induce stirring; and
   c) cooling said continuous casting mold and said electromagnetic stirring means.

2. A method of continuously casting metal billets and blooms as claimed in claim 7, wherein said stirring takes place through rotation of said molten metal about a vertical axis, said vertical axis coinciding with a longitudinal axis defined by said continuous casting mold.

3. A method of continuously casting metal billets and blooms as claimed in claim 2, wherein said stirring achieves rotation of said metal melt at two to three Hertz on said casting level.

4. A method of continuously casting metal billets and blooms as claimed in claim 2, wherein only the uppermost one of said stacked, plurality of electromagnetic stirring means is activated.

5. A method of continuously casting metal billets and blooms as claimed in claim 2, wherein cooling of said electromagnetic stirring means is separately performed from cooling of said continuous casting mold.

6. A method of continuously casting metal billets and blooms utilizing an immerged-tube casting technique and a stacked, plurality of electromagnetic stirring means arranged over the height of a continuous casting mold, said continuous casting mold being top fed, wherein:
   a) a casting stream of molten metal passes through a tube emerging from an outflow opening into said continuous casting mold in sufficient volume to form a casting level of said molten metal near the top of said continuous casting mold and above said outflow opening;
   b) casting powder is added covering said casting level;
   c) activating only the electromagnetic stirring means arranged over the lower half of said continuous casting mold to induce stirring; and
   d) cooling said continuous casting mold and said electromagnetic stirring means.

7. A method of continuously casting metal billets and blooms as claimed in claim 6, wherein said stirring takes place through rotation of said molten metal about a vertical axis, said vertical axis coinciding with a longitudinal axis defined by said continuous casting mold.

8. A method of continuously casting metal billets and blooms as claimed in 7, wherein only the lowermost one of said stacked, plurality of electromagnetic stirring means is activated.

9. A method of continuously casting metal billets and blooms as claimed in claim 6, wherein cooling of said electromagnetic stirring means is separately performed from said cooling of said continuous casting mold.

10. A method of continuously casting metal billets and blooms utilizing, one at a time, both free-stream casting and immerged-tube casting techniques with an apparatus comprising stacked upper and lower electromagnetic stirring means each arranged over a portion of the height of and around a continuous casting top fed mold, the upper one of said two stirring means being disposed over the lower one of said two stirring means comprising the steps of:

a) causing a casting stream of molten metal to enter the top of said continuous casting mold in sufficient volume to form a casting level near the top of said continuous casting mold;

b) activating at least one of said electromagnetic stirring means to induce a rotational stirring of said molten metal, at least said upper stirring means being activated during free-stream casting and only said lower electromagnetic stirring means being activated during immerged-tube casting; and c) cooling said continuous casting mold and said two electromagnetic stirring means.

* * * * *